US010899488B2

(12) United States Patent
Kivelä

(10) Patent No.: US 10,899,488 B2
(45) Date of Patent: Jan. 26, 2021

(54) BALE OPENING DEVICE

(71) Applicant: Cross Wrap Oy, Siilinjärvi (FI)

(72) Inventor: Kalle Kivelä, Tahkovuori (FI)

(73) Assignee: Cross Wrap Oy, Siilinjärvi (FI)

( * ) Notice: Subject to any disclaimer, the term of this patent is extended or adjusted under 35 U.S.C. 154(b) by 521 days.

(21) Appl. No.: 15/107,111

(22) PCT Filed: Dec. 22, 2014

(86) PCT No.: PCT/FI2014/051043
§ 371 (c)(1),
(2) Date: Jun. 22, 2016

(87) PCT Pub. No.: WO2015/097344
PCT Pub. Date: Jul. 2, 2015

(65) Prior Publication Data

US 2017/0029155 A1 Feb. 2, 2017

(30) Foreign Application Priority Data

Dec. 23, 2013 (FI) ..... 20136316

(51) Int. Cl.
*B65B 69/00* (2006.01)
*D01G 7/06* (2006.01)

(52) U.S. Cl.
CPC ..... *B65B 69/0025* (2013.01); *D01G 7/06* (2013.01)

(58) Field of Classification Search
CPC ..... B65B 69/0025; D01G 7/00; D01G 7/04; D01G 7/06; D01G 7/14
(Continued)

(56) References Cited

U.S. PATENT DOCUMENTS 3,513,522 A * 5/1970 Thomson ..... A01F 12/14 83/89
3,831,280 A * 8/1974 Brothers ..... B26B 27/00 30/296.1
(Continued)

FOREIGN PATENT DOCUMENTS

AT 389285 B 11/1989
DE 4200217 A1 * 11/1993 ..... B65B 69/0025
(Continued)

OTHER PUBLICATIONS

Finnish Patent and Registration Office, Office Action issued on FI20136316 dated Sep. 26, 2014.
(Continued)

*Primary Examiner* — Dariush Seif
(74) *Attorney, Agent, or Firm* — Berggren LLP

(57) ABSTRACT

A bale opening device for opening bales wrapped and/or tied with wrapping material comprises a supporting structure for supporting the bale to be opened, and a gripping mechanism to grip the wrapping material, and again to pull it away from the bale. In addition, the device comprises a remover taking and gripping the wrapping material from the gripping mechanism. The remover is then actuated so as to remove the wrapping material from the bale and the gripping mechanism. The remover and the gripper are mutually arranged so to enable the gripping mechanism returning back towards the supporting structure essentially at the same when the remover is actuated to remove the wrapping material.

16 Claims, 4 Drawing Sheets

(58) Field of Classification Search
USPC ..... 53/381.2; 29/426.4, 564.3; 83/909
See application file for complete search history.

(56) References Cited

U.S. PATENT DOCUMENTS 4,095,078 A * 6/1978 Waenerlund ..... B23K 11/22 219/68
4,553,312 A * 11/1985 Mitzel ..... B65B 69/0025 29/33.52
4,718,157 A * 1/1988 Keyzers ..... B65B 69/0025 29/426.4
4,794,671 A * 1/1989 Goldman ..... B65B 69/0025 100/299
4,838,751 A * 6/1989 Hanaya ..... B65B 69/0025 414/412
4,850,087 A * 7/1989 Gronau ..... B65B 69/0025 29/33 R
5,052,098 A * 10/1991 Thumm ..... B65B 69/0025 29/564.3
5,052,876 A * 10/1991 Tateno ..... B65B 69/0033 271/97
5,131,135 A * 7/1992 Gronau ..... B65B 69/0025 29/426.4
5,156,516 A * 10/1992 Boisseau ..... B65B 69/0025 29/33.52
5,199,841 A * 4/1993 Von Gehlen ..... B65B 69/0025 414/412
5,216,797 A * 6/1993 Hall ..... B26F 3/02 225/1
5,228,628 A * 7/1993 Temburg ..... B65B 69/0025 241/101.4
5,303,460 A * 4/1994 Neilsen ..... B65B 69/0025 29/426.4
5,318,399 A * 6/1994 Marom ..... B65B 69/00 414/412
5,371,938 A * 12/1994 Martin ..... B65B 69/0033 29/564.3
5,406,690 A * 4/1995 Neilsen ..... B65B 69/0025 29/33 F
5,425,219 A * 6/1995 Tanaka ..... B65B 69/0025 414/412
5,680,691 A * 10/1997 Marom ..... B65B 69/0025 29/426.4
5,813,199 A * 9/1998 Temburg ..... D01G 7/06 414/412
6,393,688 B1 * 5/2002 Axner ..... B65B 69/0025 29/426.4
6,766,630 B2 * 7/2004 Rutten ..... B65B 69/0025 242/527
6,986,233 B1 * 1/2006 Covington ..... B65B 69/0025 29/426.4
7,343,722 B1 * 3/2008 Rutten ..... B65B 69/0033 242/615.3
8,667,664 B2 * 3/2014 Norberg ..... B65B 69/0025 29/426.4
8,769,801 B2 * 7/2014 Lyman ..... B65B 69/0025 29/426.4
9,440,369 B2 * 9/2016 Bayer ..... B26D 7/025
2003/0019345 A1 * 1/2003 Platon ..... A01K 5/001 83/733
2004/0154151 A1 * 8/2004 Lile ..... B65B 69/0025 29/407.04
2005/0196266 A1 * 9/2005 Kropp ..... B65B 69/0025 414/797
2005/0199310 A1 * 9/2005 Peters ..... B65B 69/0025 140/102
2009/0211073 A1 * 8/2009 Pienta ..... B25J 9/1697 29/426.4
2010/0024188 A1 * 2/2010 Vannice ..... B25J 11/0055 29/426.3
2011/0100174 A1 * 5/2011 Norberg ..... B65B 69/0025 83/23
2011/0113941 A1 * 5/2011 Norberg ..... B65B 69/0025 83/78
2012/0255264 A1 * 10/2012 Stone ..... B65B 69/0025 53/492
2013/0000261 A1 * 1/2013 Lyman ..... B65B 69/0025 53/492

FOREIGN PATENT DOCUMENTS

DE 4241672 A1 * 6/1994 ..... B65B 69/0025
EP 0260914 A2 * 3/1988 ..... B65B 69/0025
EP 2759482 A1 7/2014
FI 100050 B 7/1997
FI 102603 B 1/1999
GB 2184704 A * 7/1987 ..... B65B 69/0025
WO 90/00498 A1 1/1990
WO 90/00499 A1 1/1990
WO WO 9213768 A1 * 8/1992 ..... B65B 69/0025
WO WO 9217373 A1 * 10/1992 ..... B65B 69/0025
WO WO 9317916 A1 * 9/1993 ..... B65B 69/0025
WO 9917993 A1 4/1999
WO 2010002336 A1 1/2010

OTHER PUBLICATIONS

European Patent Office, Supplementary European Search Report issued in EP14875034, dated Sep. 29, 2017.

* cited by examiner

BALE OPENING DEVICE

TECHNICAL FIELD OF THE INVENTION

The invention relates to a bale opening device for opening bales wrapped and/or tied with wrapping material, such as foil, film, plastic, net-like material, or other web-like wrapping material or tied with a binding material, like strap, wire or string.

BACKGROUND OF THE INVENTION

Wrapped bales are produced e.g. by providing wrapping material around the material to be wrapped. The wrapped material may be any material suitable to be wrapped, such as for example chemical pulp or waste materials, like RDF, SRF (Refuse-derived fuel (RDF) or solid recovered fuel/specified recovered fuel (SRF)) and other waste, recyclable materials and industrial materials. When the material is wrapped, it is easy to store or transfer to a further processing, such as waste bales e.g. to a combustion plant. Often there is a need to open the wrapped bales and remove the wrapping material for example before further processing, for example before further processing of the waste bale, such as recycling or combusting the waste material.

The bales are opened according in numerous ways according to known prior arts, such as by crusher like devices, which crushes the bales and the wrapping material and thereby release the wrapped material inside the bale. Also more sophisticated bale openers are used for removing the wrapping material, such as wrapping film and bale wires around the bales, enabling thereby the material to be utilised, for example, as an energy source, without any crushing the material inside the bale. Often the bale opener has a cutting means for cutting the wrapping material and gripping mechanism, which grips and cuts the wrapping material and removes it by pulling movement. The previous bale opener developed by the applicant comprises also rollers, where the gripping mechanism pulls the wrapping material between the rollers, after which the rollers are pressed against each other and rotated so to remove the wrapping material more efficiently away from the bale.

Even though the previous bale opener has several advantages, there are still some disadvantages relating to it, such as sometimes it might be that the wrapping material sticks to the rollers, which causes inefficiency of the bale opener. In addition when the gripping mechanism pulls the wrapping material between the rollers, the bale opener cannot be used at that time, because the bale opener must wait the gripping mechanism returning back. However the gripping mechanism can return only after the rollers have removed the wrapping material from the bale (and possibly also from the gripping mechanism) and when the rollers have again been opened so that the gripping mechanism can return back.

In addition there are still some disadvantages related to the removed wrapping material, namely often the wrapping materials are just stacked in the next of the opener, whereupon the wrapping material pile at the ground nearby the bale opener is a security risk and additionally litters the free space near the opener. A solution is known where the bale opener is located on a platform and where a loading pallet is located under or beneath the rollers ejecting the wrapping material. Other way is to provide a cave onto the ground and place the loading pallet into the cave and below the opener. Anyway it is clear that these solutions have drawbacks, namely it is very impractical to provide this kind of additional construction for the bale openers.

SUMMARY OF THE INVENTION

An object of the invention is to alleviate and eliminate the problems relating to the known prior art. Especially the object of the invention is to provide a bale opening device for opening wrapped and/or tied bales efficient, reliable and fast way, and to minimize possible malfunctions, such as to eliminate problems relating to sticking of the wrapping materials to the bale opening device. In addition the object is to fasten the process so that there is no need to wait the removing of the wrapping material before the gripping means can return back to its position and for introduction to the next bale to be opened.

The object of the invention can be achieved by the features of independent claim.

The invention relates to a device bale opening device according to claim 1.

According to an embodiment of the invention a bale opening device comprises a supporting structure for supporting the bale to be opened. The supporting structure may be for example a table or other structure suitable for receiving and holding the bale during the opening and wrapping material removing process. The supporting structure may be essentially horizontally arranged table, which may also be, according to an example, pivoted and/or hinged table, thereby allowing rotational or inclined movement of the bale on the supporting structure. According to an embodiment the supporting structure can be functionally coupled with a conveyor transferring the bale to the supporting structure for opening. Of course it is to be understood that the bale can be provided to the table also by other way, such as bringing it by a truck or the like.

According to another embodiment the supporting structure may be implemented by a clamping mechanism. The clamping mechanism comprises advantageously at least two fork-like means (like in a fork lift truck), which may be coupled with the gripping mechanism and which are advantageously configured to be centralized around the bale with a free mutual movement thereof, so moved towards to and away from the bale. The clamping mechanism is advantageously used, when the bale opening device is as a mobile vehicle.

The bale opening device comprises advantageously also a gripping mechanism, which is configured to be introduced with the bale and to grip said wrapping material, and again to be moved away from the bale so that the wrapping material gripped by gripping means is removed from the bale at the same time during pulling. According to an example the bale opening device comprises one gripping means configured to grip said wrapping material. According to an example the bale opening device comprises two gripping means, which are both configured to move towards the bale and thus towards each other. In particularly this is advantageous in the embodiment, where the two gripping means are arranged in the connection of the clamping mechanism, where the clamping mechanism can be the gripping mechanism can also be implemented by only one gripping means.

The removing (at least initial removing movements) of the wrapping material from the bale can be implemented e.g. by pulling out said gripping means from the bale, either by using one or more gripping means.

The first gripping mechanism is configured to grip and introduce the wrapping material to a removing means, which is configured to grip and wind the wrapping material, and thereby remove it from the bale and from the gripping mechanism. In addition, according to an advantageous embodiment when two gripping means are used, the second gripping mechanism is also configured to grip and keep the wrapping material, by in addition said gripping means is additionally configured to loosen its grip of the wrapping material and thereby facilitating the removing of the wrapping material by the removing means. The second gripping mechanism may be configured to pull the wrapping material only a distance, which is much shorter that the pulling distance of the first gripping mechanism.

The device advantageously comprises also a cutting means for cutting the wrapping material at least in one side of the bale for removing so that the wrapping material will be loosen and released in a controlled manner and that the gripping means does not break or tear the wrapping material in an uncontrolled manner, whereupon the bale material would spread all around and litter the environment of the device. The cutting means may be implemented e.g. by a cutting blade, but also other cutting means are possible. The cutting means may be arranged in the connection of the gripping mechanism and/or cutting means may be a separately operated cutting means. It is to be noted that the device may comprise one or more cutting means, such as one cutting means at the bottom, one cutting means configured to cut the leading edge of the bale and one cutting means arranged essentially at the opposite side of the bale than the gripping means pulling out the wrapping material and introducing it to the removing means. Again it is to be noted that the cutting of the wrapping material may be performed when the gripping mechanism is introduced with the bale, but advantageously before the gripping mechanism pull the wrapping material entirely away from the bale.

According to an embodiment one cutting means is configured to cut the wrapping material in the leading edge of the bale or at the portion of the bale locating between the leading edge and said second gripping means. This offers very advantageous embodiment, namely when the wrapping material is cut at the leading edge or at the portion between the leading edge and the second gripping means and the wrapping material is gripped by the second gripping means, the waste material of the bale will be unloaded via said created opening pointing towards the leading edge of the bale. Thus the bale can be moved further at the same time when the first gripping means is pulling the wrapping material and bringing it to the removing means for final removing. In addition when the wrapping material is still gripped by the second gripping means, it minimizes the possibility that the material inside the bale would fall into the wrong direction or backwards, such as back to the conveyor or other structure of the device, and thus facilitates the movement of the bale material forwards into the desired direction.

According to an embodiment the gripping mechanism is configured to bypass said removing means, which in turn is configured to grip said wrapping material after the bypassing. According to an advantageous embodiment the removing means is configured to allow the returning movement of the gripping mechanism. This can be achieved by moving the removing means side (sidestep) when gripped the wrapping material and thereby to allow the gripping mechanism to return back to its original position (near the bale to be opened), or the mechanical structure of the removing means may be such that it allows the returning movement of the gripping mechanism. In addition according to an embodiment the removing mechanism may be arranged at the side of the moving path of the gripping means, whereupon the wrapping material may be provided to the removing means either sidewise movement of the gripping means or the wrapping material is transferred from the gripping means to the removing means by an intermediary or another additional operator. In particularly, according to an example the removing means is configured to enable said gripping mechanism to be moved back towards said supporting structure supporting the bale essentially at the same with winding It is to be noted that the removing means of the device described in this document may be configured to move to the side after gripping the wrapping material and thereby enabling the gripping mechanism to move back towards said supporting structure (and possibly to the new bale) essentially at the same with winding or removing the wrapping material. The removing means may also be arranged at the side and the gripping means or other additional operator is configured to introduce the wrapping material to the removing means by the movement of the gripping mechanism or the additional operator transferring at least portion of said wrapping material to the removing means.

It is to be understood that the wrapping material may be any material used for manipulating the bale so that the bale material is hold together. Thus the wrapping material is advantageously selected in accordance with the bale material to be wrapped. Thus the wrapping material may be e.g. foil, film, shrink film, plastic, net-like material, or other web-like wrapping material or binding material, like band, strap, wire or string made of plastic or metal, or combinations of previously mentioned, for example. The wrapping material is used in this document to mean all kinds of material and ways used for wrapping, binding or holding the bale material together.

The present invention offers advantages over the known prior art, such as enabling the opening of the wrapped bales efficient, reliable and fast way. In addition possible malfunctions, such as problems relating to sticking of the wrapping materials to the bale opening device can be effectively minimized or even removed. In addition the opening process is very fast since there is no need to wait the removing of the wrapping material before the gripping means can return back to its position and for introduction to the next bale to be opened. Moreover amount of dust can be reduced by the present invention in relation to e.g. crusher like devices or more robust bale openers, which breaks the bale material at least partly. The dust causes many disadvantages, such as pollution as well as a fire or explosion risk.

Furthermore the devise according to the current invention can be arranged is much smaller space than the previous ones, especially the crusher like devices. Because the smaller space requirements and lighter structures the basements for the device according to the current invention can be made much more lighter, which means in practice much more inexpensive and faster ways. Because the operation of the device is not so aggressive than of the crusher like devices, the maintenance intervals can be extended, which indicates directly to the productivity.

BRIEF DESCRIPTION OF THE DRAWINGS

Next the invention will be described in greater detail with reference to exemplary embodiments in accordance with the accompanying drawings, in which.

DETAILED DESCRIPTION

Figure 1A:
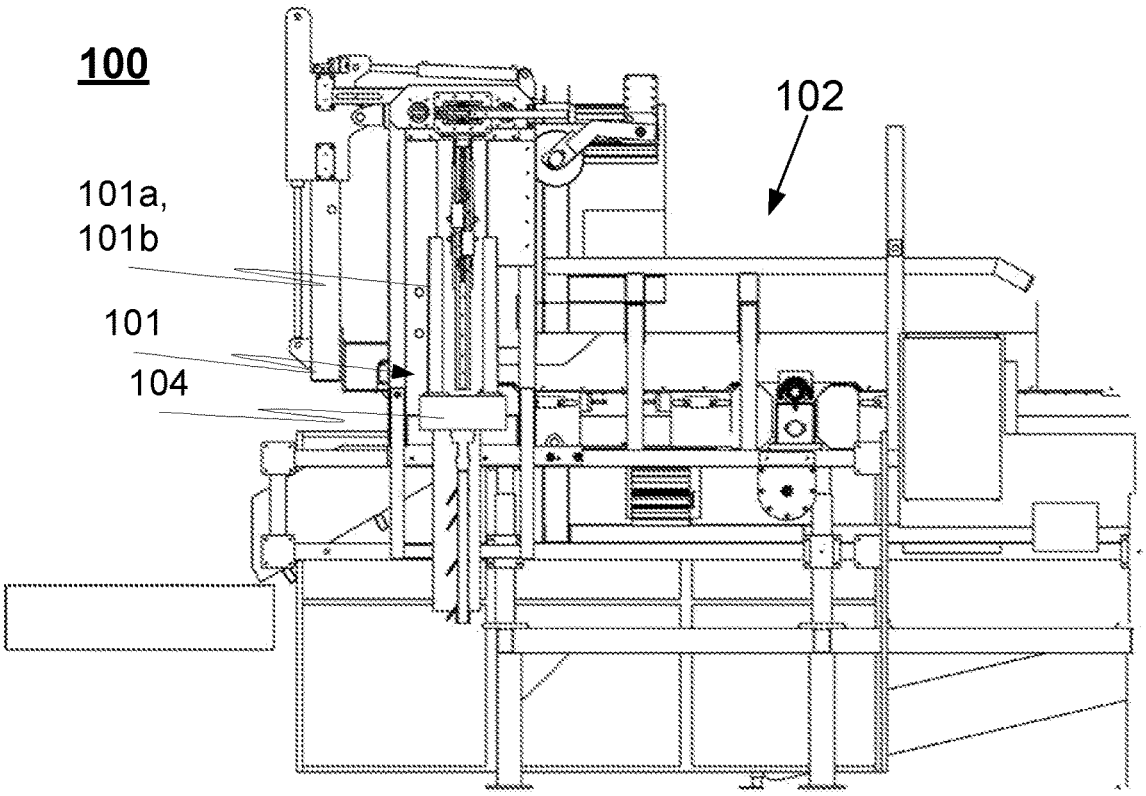
FIGS. 1A-1B illustrate a side view of an exemplary bale opening device 100 for opening wrapped bales according to an advantageous embodiment of the invention.
Figure 1B:
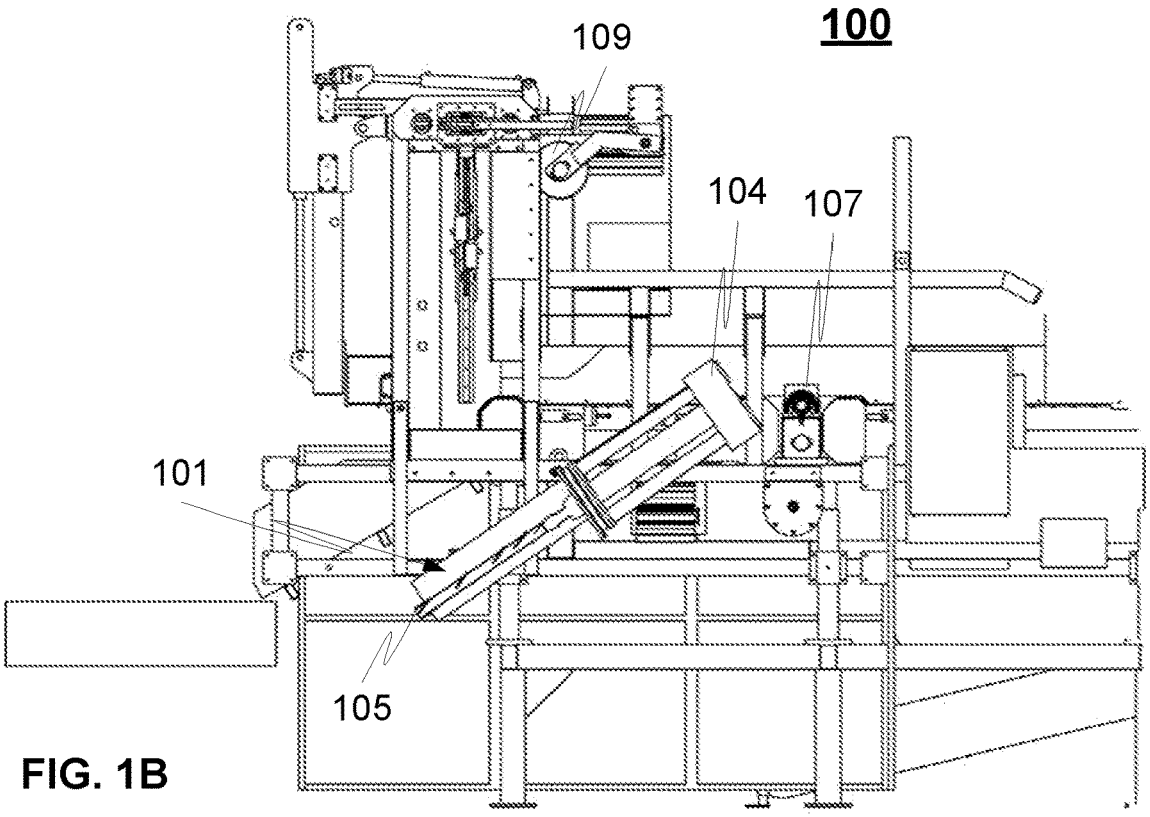

FIGS. 1A-1B illustrate a side view, FIGS. 2A-2D illustrate a frontal view, and FIGS. 3A-3D illustrate a top view of an exemplary bale opening device 100 and its functional steps and method for opening wrapped bales according to an advantageous embodiment of the invention, which are described in more details below.

The bale opening device 100 comprises a supporting structure 102 for supporting bale to be opened (bale is not shown). In addition the device 100 comprises also a gripping mechanism 103 configured to be introduced with the bale (step 10), to grip the wrapping material (step 10), and again to be moved away (steps 20, 30, 40) from the bale with the gripped wrapping material. The bale opening device 100 comprises also a removing means 101, which again comprises at least one rod 101*a*, 101*b* or tumbler, which is configured to catch and grip the wrapping material when introduced by the gripping means 103. This can be implemented e.g. so that the removing means comprises at least one rod 101*a*, 101*b* between which the gripping means 103 is configured to be moved with the gripped wrapping material, as can be seen e.g. in FIGS. 3A-3C. The removing of the wrapping material can be implemented by winding or rotating the removing means 101, such as said rods 101*a*, 101*b*, whereupon the wrapping material is coiled or winded into a kink or cluster, such as a conglobation.

Even if the removing means 101 may be implemented in many ways, one advantageous embodiment is shown in Figures, where the removing means 101 comprises two longitudinal, essentially parallel rods 101*a*, 101*b*. The rods may are advantageously coupled to have a common rotation point 101*c* in the area between the rods so that they are rotatable around the common rotation point and thereby causing the winding effect for the wrapping material. The gripping mechanism 103 is then configured to move between said two rods 101*a*, 101*b* (from the position described in FIG. 2A, 2B or 3A to the position described in FIG. 2D or 3D; and especially step 30), after which the rods can be rotated at least few rounds (step 40) and thereby gripping the wrapping material (so when the gripping mechanism 103 is at position described in FIG. 2D or 3D).

Figure 2A:
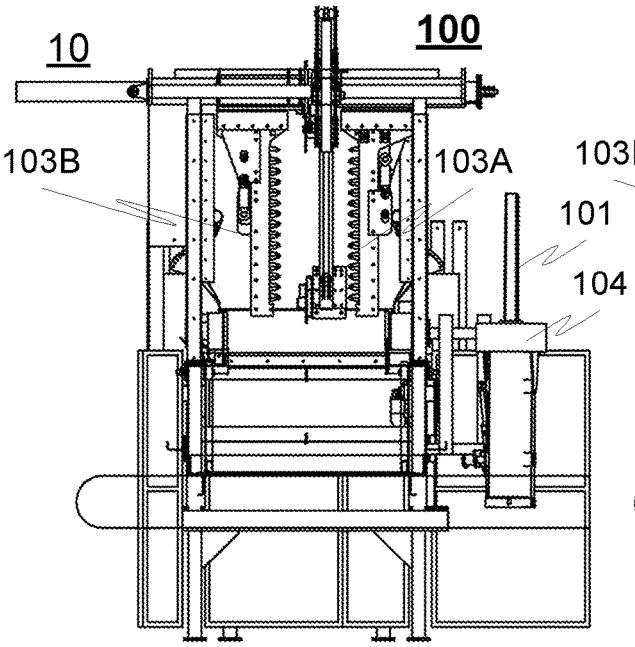
FIGS. 2A-2D illustrate a frontal view of an exemplary bale opening device 100 for opening wrapped bales during different opening phases according to an advantageous embodiment of the invention.
Figure 2B:
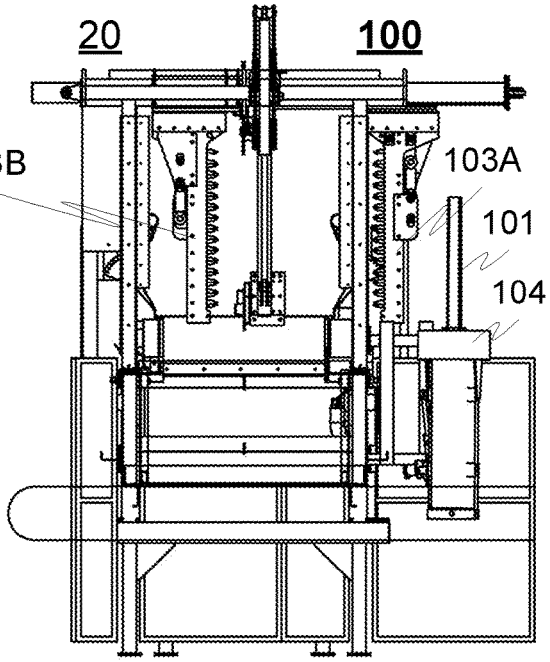
Figure 2C:
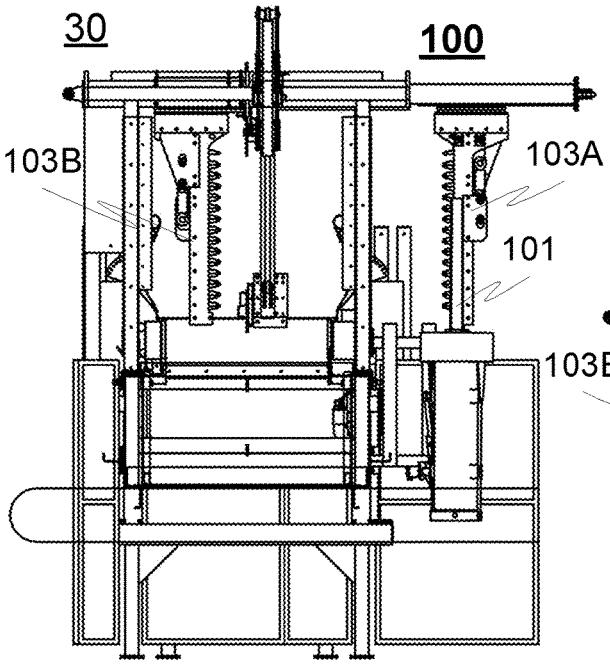
Figure 2D:
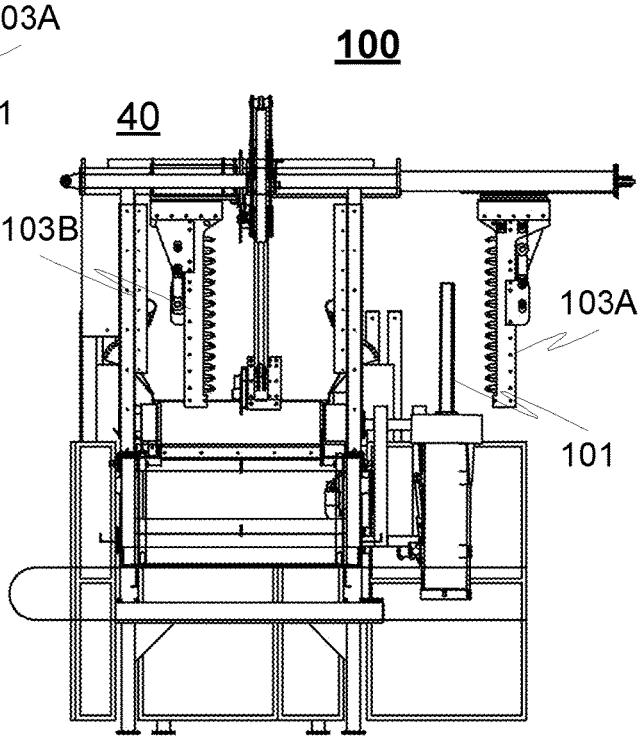
Figure 3A:
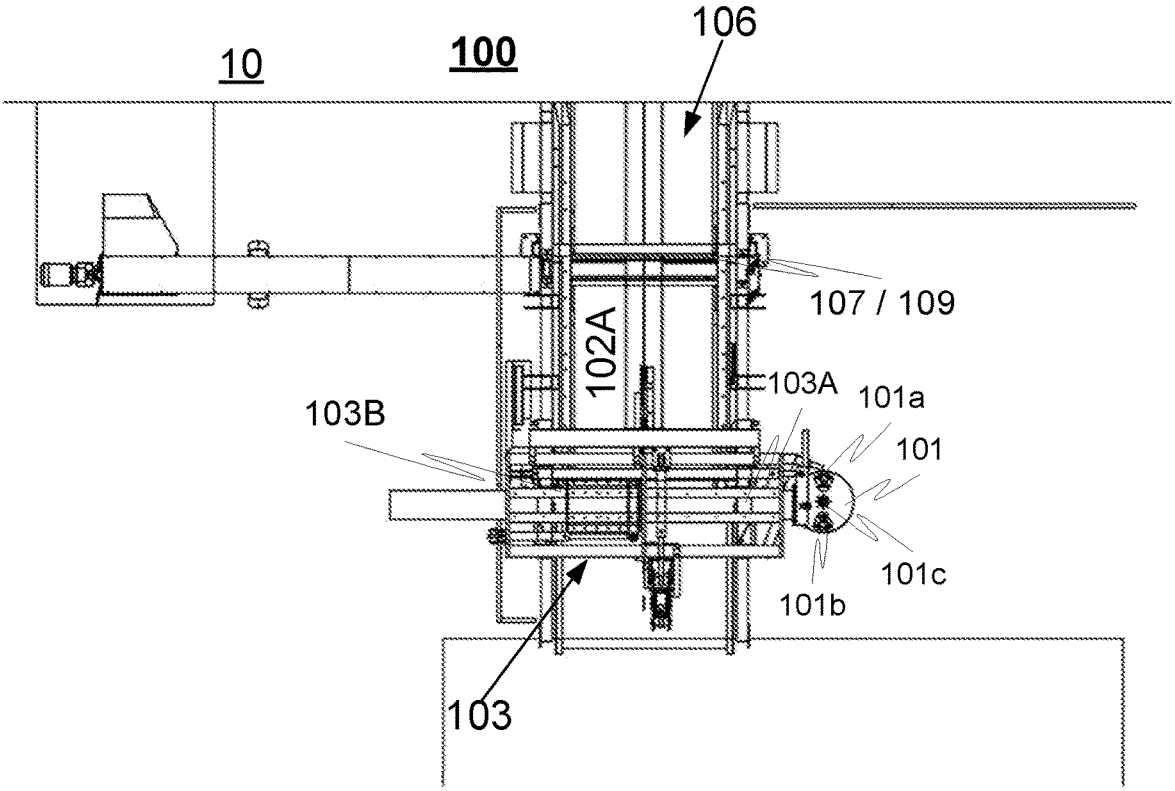
FIGS. 3A-3D illustrate a top view of an exemplary bale opening device 100 for opening wrapped bales during different opening phases according to an advantageous embodiment of the invention.
Figure 3B:
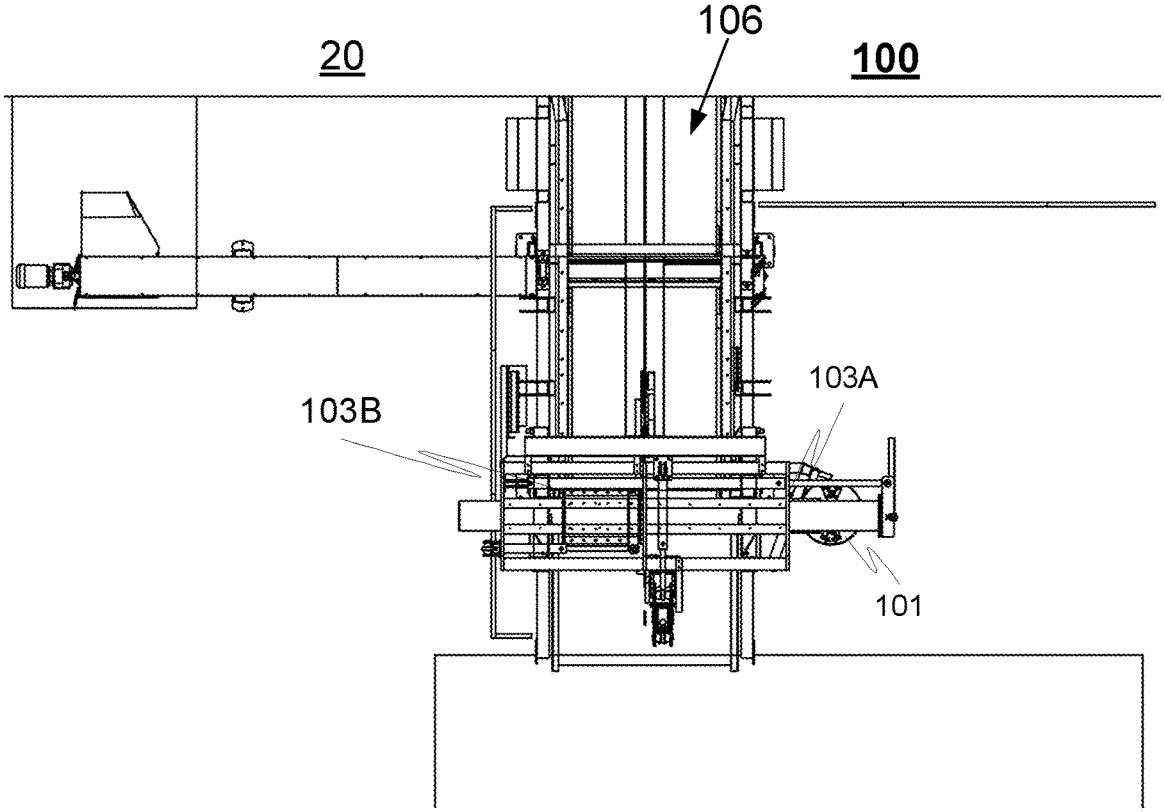
Figure 3C:
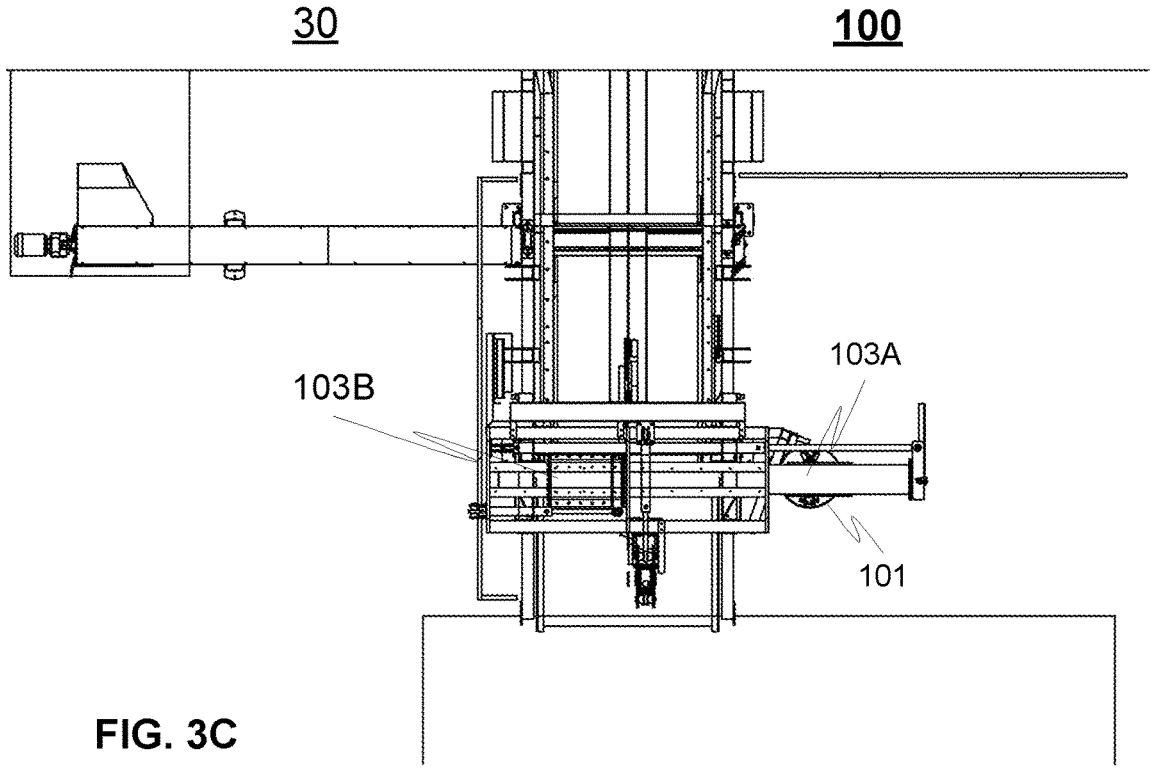
Figure 3D:
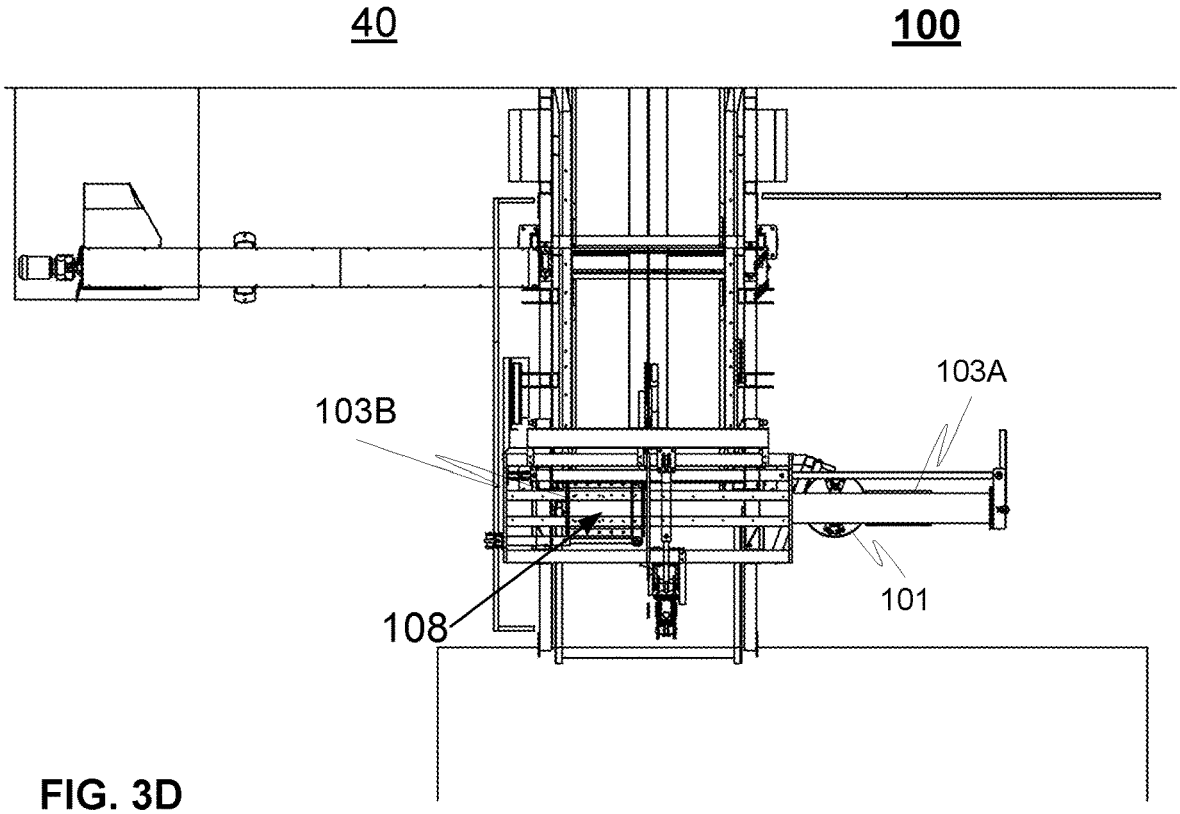

After the removing means 101 has gripped the material, the gripping means 103 may release the wrapping material and return its original position, so back to the vicinity of the area where the bales to be opened is introduced (to the position described in FIG. 2A or 3A). The retuning movement of the gripping means can be implemented e.g. by stopping the rotation of the rods 101*a*, 101*b*, whereupon the gripping means 103 may move back to its original position between the stationary rods, whereupon the rods can be rotated again when the gripping means has bypassed them (position described in FIG. 2B or 3A), or the retuning movement of the gripping means may be implemented by sidestepping the removing means (such as described in FIG. 1B).

The removing means is configured, according to an embodiment, to move side, thereby allowing the returning movement of the gripping means. The side movement may be totally horizontal movement or inclination as described in FIG. 1B, but also other side movements are possible. It is to be noted that the removing means may be actuated, such as rotated, advantageously simultaneously when the gripping means is returning (especially if the side step or side moving of the removing means is implemented). This fastens the bale opening process very much, because there is no need to wait the total removing of the wrapping material before the gripping mechanism can return.

When the wrapping material has been removed from the bale by rotating the rods 101*a*, 101*b*, the wrapping material must also be cleared from the rods.

Thus the device advantageously comprises also a clearing means 104 for clearing the wrapping material from the removing means 101, especially from the rods 101*a*, 101*b*, after winding said wrapping material. The clearing means may be arranged in the connection of the removing means. The clearing means may be for example a plate or the like 104, which is configured to move along the rod e.g. towards the free end of the rod and thereby push and clear the wrapped material wound around said rod(s) away, such as is shown in FIG. 1B.

It is to be noted that the removing means, such as rods, may be pivoted 105 so to allowing sidestep movement of the removing means, whereupon due to clearing the wrapped material wound can be transferred at the distance from the bale opener, such as to the loading pallet. According to an example the device may also comprise another type of clearing means, such as a groove or the like in the connection with loading pallet, whereupon the relative movement of the removing means and the groove may be arranged so to clear the wrapped material around the removing means, especially around the rods (not shown). This has cleat advantages namely the device can keep the removing means as well as environment of the device easily clear, which again improves safety, since there is no litters in the vicinity of the device.

According to an embodiment the removing means 101 may also be implemented by at least one rotating roller 101*a* and a counter part of it, which may be another rotating roller 101*b* or a fixed body. The roller and/or the counter-part may be arranged so that they allow the movement of the gripping means between them and introduction of the wrapping material to the removing means. For example the first roller and the counter-part may be pressed against each other after the gripping mechanism has been moved between them, after which the roller and the counter-part may be moved side with the wrapping material (which is pressed between the roller and the counter-part) and thereby allowing the returning movement of the gripping mechanism. The removing of the wrapping material is implemented by rotating at least roller so that it will pull the wrapping material away from the bale as well as from the gripping mechanism. Again it is to be noted that the roller and its counter-part may be configured to perform sidestep movement so to remove the wrapping material at the distance, such as to the loading pallet. Advantageously the removing means comprises two rotating rollers, which can be rotated into the both directions (clockwise and counter clockwise), whereupon the rollers may clean e.g. possible jams easily.

Still, according to an exemplary embodiment the removing means may be implemented by at least one hook mechanism 101*a*, 101*b*, arranged so that said gripping mechanism is enabled to move next to the hook mechanism and thereby introduce the wrapping material to the hook mechanism. The introduction may also be implemented by an additional operator, or the hook may be arranged to make a hooking movement and thereby catch the wrapping material. In addition, the hook is configured to be actuated, such as hook and/or rotate so to grip to the wrapping material introduced by said gripping means or any additional operator. The movement of the hook can be implemented so to allow the returning ovement of the gripping mechanism. The hook may be arranged into a pivoted arm, for example.

According to an example the hook mechanism comprises also a clearing mechanism, which can be implemented e.g. by a frame having an opening, through which the hook is pivoted in a turning manner. After the hook has been actuated and thereby the wrapping material has been removed from the bale, the cleaning of the hook can be performed by turning the hook through the opening so that the rim of the opening is configured to clean any wrapping material from the hook during turning movement of the hook through the opening.

According to an embodiment the bale opening device may comprise at least two gripping means 103A, 103B, which are configured to be introduced around the bale to be opened and to press the bale and thereby inducing pressure into the bale and stress to the wrapping material, whereupon the wrapping material is easy to cut.

The gripping mechanism used in the bale opening device may be any gripping mechanism known from the prior art. It may comprise for example a frame element and tooth means (gripper) coupled with the frame element. The tooth means may be configured to move in an overlapping manner or relatively to each other so to leave e.g. loops between the tooth means, but still inducing pressure to the wrapping material without cutting it, and thereby providing gripping effect to the wrapping material of the bale.

The supporting structure 102 may comprise e.g. a table 102A, which is configured for receiving the bale to be opened. The supporting structure may be coupled with a conveyor 106 for transferring the bale to the supporting structure. The bale opener may also comprise a roller 107 arranged between the supporting structure 102, 102A and the conveyor 106, where the roller comprises a cutting means, such as a blade, having common rotation axis with the roller. The roller facilitates the transferring of the bale from the conveyor to the table so that the bale would not jam between them. Additionally when the roller comprises the blade, it cuts the wrapping material in the bottom side of the bale at the same time when transferring the bale from the conveyor to the table.

It is to be noted that the bale opening device may also be implemented as a mobile device, even if only stationary mounted devices are only shown in Figures. There the supporting structure 102 comprises advantageously a clamping mechanism, where the clamping mechanism comprises at least two fork-like means. The fork-like means may comprise the gripping mechanism 103 and configured to be centralized around the bale with a free mutual movement thereof, when it is moved towards the bale.

It is to be noted that the mobile device may comprise any of the bale opening devices and functionalities described in this document, such as the gripping means 103 and especially the removing means 101. In addition it is to be noted that the "non-mobile" (fixedly mounted) bale opening device may also comprise clamping mechanism 108 for holding the bale in the place during gripping and cutting operations, as well as also during removing operation of the wrapping material.

The opening device comprises advantageously also a cutting means 109, such as a blade, configured to cut the wrapping material at least in one side of the bale when said gripping mechanism 103 (step 10) is introduced with the bale, but advantageously before said gripping mechanism 103 is moved away (steps 20, 30) from the bale with said gripped wrapping material.

The invention has been explained above with reference to the aforementioned embodiments, and several advantages of the invention have been demonstrated. It is clear that the invention is not only restricted to these embodiments, but comprises all possible embodiments within the spirit and scope of the inventive thought and the following patent claims. Especially it is to be noted that the bale opening device may be implemented by a device locating essentially stationary on the ground, or it can be implemented by a mobile device having suitable clamping mechanism and other bale opening functions and means described in this document. In addition it is to be noted that the wrapping material may be e.g. foil or film, plastic material, net-like material, or other web-like wrapping material, and that the invention is not limited to any special wrapping material. In addition the bale may be bound or tied by binding material, such as strap, wire or string, such as plastic or metal material, which can be construed as said wrapping material removed by the bale opening device according to the present invention. Of course it is also to be understood that the current invention can be applied with any kinds of wrapped bales, and is not limited only for the waste material bales.

The invention claimed is:

1. A bale opening device for opening bales by removing a wrapping material, the wrapping material comprising one or more of an enclosing material and a binding material, wherein the device comprises:

a supporting structure for supporting a bale to be opened;

a gripping mechanism, introduced near the bale, configured to mechanically catch and grip any of the enclosing material and the binding material of the wrapping material for the bale to be opened, and further configured to move away from the bale with said mechanically caught and gripped wrapping material by a mutual movement of the gripping mechanism and the bale;

a cutting device configured to cut the wrapping material at least on one side of the bale when said gripping mechanism is introduced near with the bale but before said gripping mechanism is moved away from the bale with said mechanically caught and gripped wrapping material; and a remover comprising one or more longitudinal rods configured to be rotated around a rotation axis, wherein the gripping mechanism with the mechanically caught and gripped material is moved to a vicinity of the one or more longitudinal rods, the remover is configured to be actuated to rotate the one or more longitudinal rods around the rotation axis to wind and catch the wrapping material from the gripping mechanism for removing the wrapping material from the bale, wherein the remover and the gripping mechanism are mutually arranged to enable the gripping mechanism moving back toward the supporting structure from the vicinity of the one or more longitudinal rods after said wrapping material is caught by the remover and while said remover is actuated to remove said wrapping material.

2. The device of claim 1, wherein the remover includes at least two longitudinal rods, and the gripping mechanism is configured to move and introduce said wrapping material between the at least two longitudinal rods, whereupon said at least two longitudinal rods are configured to be actuated to wind and catch said wrapping material.

3. The device of claim 2, wherein said at least two longitudinal rods are rotatable around a common rotation axis for winding and catching said wrapping material.

4. The device of claim 1, wherein the device further comprises a clearing plate for clearing said wrapping material from the remover.

5. The device of claim 4, wherein said clearing plate is configured to be moved along the one or more longitudinal rods in order to push and remove the wrapped material wound around the one or more longitudinal rods.

6. The device of claim 1, wherein said remover is configured to move aside after catching said wrapping material thereby enabling said gripping mechanism to move back toward the supporting structure from the vicinity of the one or more longitudinal rods.

7. The device of claim 1, wherein the wrapping material is transferred to the remover by the movement of the gripping mechanism or by introducing an additional device transferring at least a portion of said wrapping material to the remover.

8. The device of claim 1, wherein said remover is coupled with a pivoted or movable arm, wherein said arm is configured to move in relation to a pivot point and enable transferring the wrapping material from the remover.

9. The device of claim 1, wherein the cutting device is arranged in connection with said gripping mechanism.

10. The device of claim 1, comprising at least two gripping mechanisms configured to be introduced around the bale to be opened and to press the bale inducing a pressure into the bale and a stress to the wrapping material in order to facilitate cutting of the wrapping material.

11. The device of claim 10, wherein a first of the two gripping mechanisms is configured to pull the gripped wrapping material from the bale and wherein a second of the two gripping mechanisms is configured to be stationary or move only a shorter distance than said first gripping mechanism and grip the wrapping material during the movement of the first gripping mechanism.

12. The device of claim 1, wherein said gripping mechanism includes a frame element and tooth means coupled with said frame element, wherein said tooth means are configured to move in an overlapping manner or relative to each other and grip said wrapping material of the bale.

13. The device of claim 1, wherein the supporting structure is a horizontal hinged and pivoted table or plate, or a horizontal hinged or pivoted table or plate configured to be coupled with a conveyor for transferring said bale for removing the wrapping material.

14. The device of claim 1, wherein said bale opening device is a mobile vehicle.

15. The device of claim 1, wherein the enclosing material is a foil, a film, a plastic material or a net-like material.

16. The device of claim 1, wherein the binding material is a strap, a wire or a string.

* * * * *